US005129696A

United States Patent [19]

Underwood

[11] Patent Number: 5,129,696

[45] Date of Patent: Jul. 14, 1992

[54] ADJUSTABLE CARPET STRETCHER

[76] Inventor: Patrick S. Underwood, 7915 Silverton Ave., Ste. 312, San Diego, Calif. 92126

[21] Appl. No.: 723,337

[22] Filed: Jun. 28, 1991

[51] Int. Cl.[5] ..... A47G 27/04

[52] U.S. Cl. ..... 294/8.6; 254/200

[58] Field of Search ..... 294/8.6; 254/200, 201, 254/212

[56] References Cited

U.S. PATENT DOCUMENTS

| | | | |
|---|---|---|---|
| 1,160,647 | 11/1915 | Owens | 254/212 |
| 2,714,274 | 8/1955 | Hill | 294/8.6 |
| 2,876,583 | 8/1959 | Young | 294/8.6 |
| 2,882,642 | 4/1959 | Hill | 294/8.6 |
| 3,359,032 | 12/1967 | Kochanowski | 294/8.6 |
| 3,374,023 | 3/1968 | Hill et. al. | 294/8.6 |
| 3,572,800 | 3/1971 | Graziano | 254/200 |
| 3,866,964 | 2/1975 | Prater | 294/8.6 |
| 3,977,651 | 8/1976 | Chamberlain | 254/201 |
| 4,119,338 | 10/1978 | Agcaoili | 294/8.6 |
| 4,627,653 | 12/1986 | Koroyasu | 294/8.6 |

*Primary Examiner*—Margaret A. Focarino
*Assistant Examiner*—Joseph D. Pape
*Attorney, Agent, or Firm*—David L. Baker

[57] ABSTRACT

An adjustable carpet stretcher has an outer tubular member, a first inner tubular member within the outer tubular member and a telescoping second inner tubular member within the outer tubular member. There is a locking member and an outer tubular member stabilizer bushing. There is a securing bushing releasingly attached to the second inner tubular member by a second inner tubular member fastener. A mounting bushing and a spacer member are on the second inner tubular member. A mounting plate is releasingly secured to the securing bushing. A carpet skid is releasingly attached to the mounting bushing. There is a knee pad and a knee pad retaining member. A carpet gripping head has a base plate and a primary tooth plate, adjustably and removably attached to the base plate, that has a plurality of primary teeth thereon. A primary tooth plate adjustment member, adjustably attached to the base plate and to the primary tooth plate, adjusts a depth to which the primary teeth of the primary tooth plate may penetrate the carpet. At least one secondary tooth plate, removably attached to the base plate, has a plurality of secondary teeth thereon. There may be a tooth plate stabilizer bushing to reduce movement of the primary tooth plate. There is a light device to illuminate an area near the gripping head and a power source for the light device.

4 Claims, 2 Drawing Sheets

ADJUSTABLE CARPET STRETCHER

BACKGROUND OF THE INVENTION

1. Field of the Invention

This invention relates to a continuously adjustable, illuminated knee-kick operated, carpet stretcher that has several improvements that assist the user to more efficiently install a carpet.

2. Description of the Related Art

U.S. Pat. No. 2,714,274 to H. J. Hill on Aug. 2, 1955 for a Knee Kicker Carpet Stretcher shows a stretcher that has a projection in front of the head that smooths out the carpet and assists the engaging of the carpet with a carpet tack board.

U.S. Pat. No. 2,876,583 to S. G. Young on Mar. 10, 1959 describes a Knee Kicker having a construction making it lighter.

U.S. Pat. No. 3,374,023 to H. J. Hill, et al., on Mar. 19, 1968 shows a Carpet Stretcher having an adjustable-length shank having an inner shaft and an outer shaft telescoping over the inner shaft. The outer shaft is limited in the number of positions it may be set. Unlike the present invention which may be adjusted to any position on the inner tubular member.

U.S. Pat. No. 3,572,800 to A. J. Graziano on Mar. 30, 1971 describes a Pneumatic Carpet Stretcher having a cylindrical shock reducing mechanism to reduce shock to the knee.

U.S. Pat. No. 4,119,338 to C. R. Agcaoili on Oct. 10, 1978 shows an Adjusting Shank Length Carpet Kicker having a shank that may be rotated 90 degrees to extend or reduce the shank length and then rotated back to lock the shank.

U.S. Pat. No. 4,627,653 to A. Koroyasu on Dec. 9, 1986 describes a Carpet Stretcher having an air cylinder shock absorbing cylinder to reduce shock to the knee.

SUMMARY OF THE INVENTION

In order to lay carpeting on a floor so that the finished job is tightly fit to the floor without unsightly folds, wrinkles and creases, a carpet installation tool such as a knee kicker is needed. It is so named because the carpet installer positions himself behind the tool and strikes a knee pad on the tool with his knee. The blow to the pad is transmitted to a carpet gripping head whose teeth engage the carpet and the carpet is stretched in the direction of the blow. Constantly striking the pad with the knee causes sore and tender knees after a short time. The construction of the present invention reduces the chance of injury to the installer's knee.

An adjustable carpet stretcher used in combination with a carpet is described that has an outer tubular member, a first inner tubular member within the outer tubular member and a telescoping second inner tubular member within the outer tubular member. There is a locking member, on the second inner tubular member, to releasingly secure the outer tubular member to the second inner tubular member. An outer tubular member stabilizer bushing is on the second inner tubular member. There is a securing bushing releasingly attached to the second inner tubular member by a second inner tubular member fastener. A mounting bushing is on the second inner tubular member. There is a spacer member on the second inner tubular member. A mounting plate is releasingly secured to the securing bushing.

A carpet skid is releasingly attached to the mounting bushing. There is a knee pad releasingly connected to the carpet skid. There is a knee pad retaining member, attached to the securing bushing, to restrict the movement of the knee pad.

A carpet gripping head is attached to the first inner tubular member. The carpet gripping head may have a base plate and may have a primary tooth plate, adjustably and removably attached to the base plate, that has a plurality of primary teeth thereon. There may be a primary tooth plate adjustment member, adjustably attached to the base plate and to the primary tooth plate, to adjust a depth to which the primary teeth of the primary tooth plate may penetrate the carpet. There may be at least one secondary tooth plate, removably attached to the base plate, having a plurality of secondary teeth thereon. There may be a tooth plate stabilizer bushing to reduce movement of the primary tooth plate.

The outer tubular member may have a gripping surface on a surface of an outer wall. The first inner tubular member within the outer tubular member may have a light device to illuminate an area near the gripping head and a power source for the light device.

It is an object of this invention to provide a carpet stretcher having a gripping head that will hold the teeth securely and stably.

It is an object of this invention to provide a carpet stretcher having a larger more padded knee pad and a skid that will reduce the chance of injury to the user's knee.

It is another object of this invention to provide a carpet stretcher that reduces the occurrence of the teeth of the gripping head working loose and wobbling.

It is another object of this invention to provide a carpet stretcher that permits the user to adjust the depth to which the teeth will penetrate the carpet.

It is yet another object of this invention to provide a carpet stretcher that has a light to illuminate an area having little or no light therein.

It is another object to provide a carpet stretcher that enhances the ability of the user to grip the stretcher when the user's hands are sweaty.

It is another object of this invention to provide a carpet stretcher with a carpet skid device that assists the user to lift the stretcher off the carpet during the stretching process.

It is yet another object of this invention to provide a carpet stretcher that has a knee pad position retaining member to restrict the upward movement of the knee pad when the user kicks the pad during the stretching process.

DESCRIPTION OF THE PREFERRED EMBODIMENT

Figure 1:
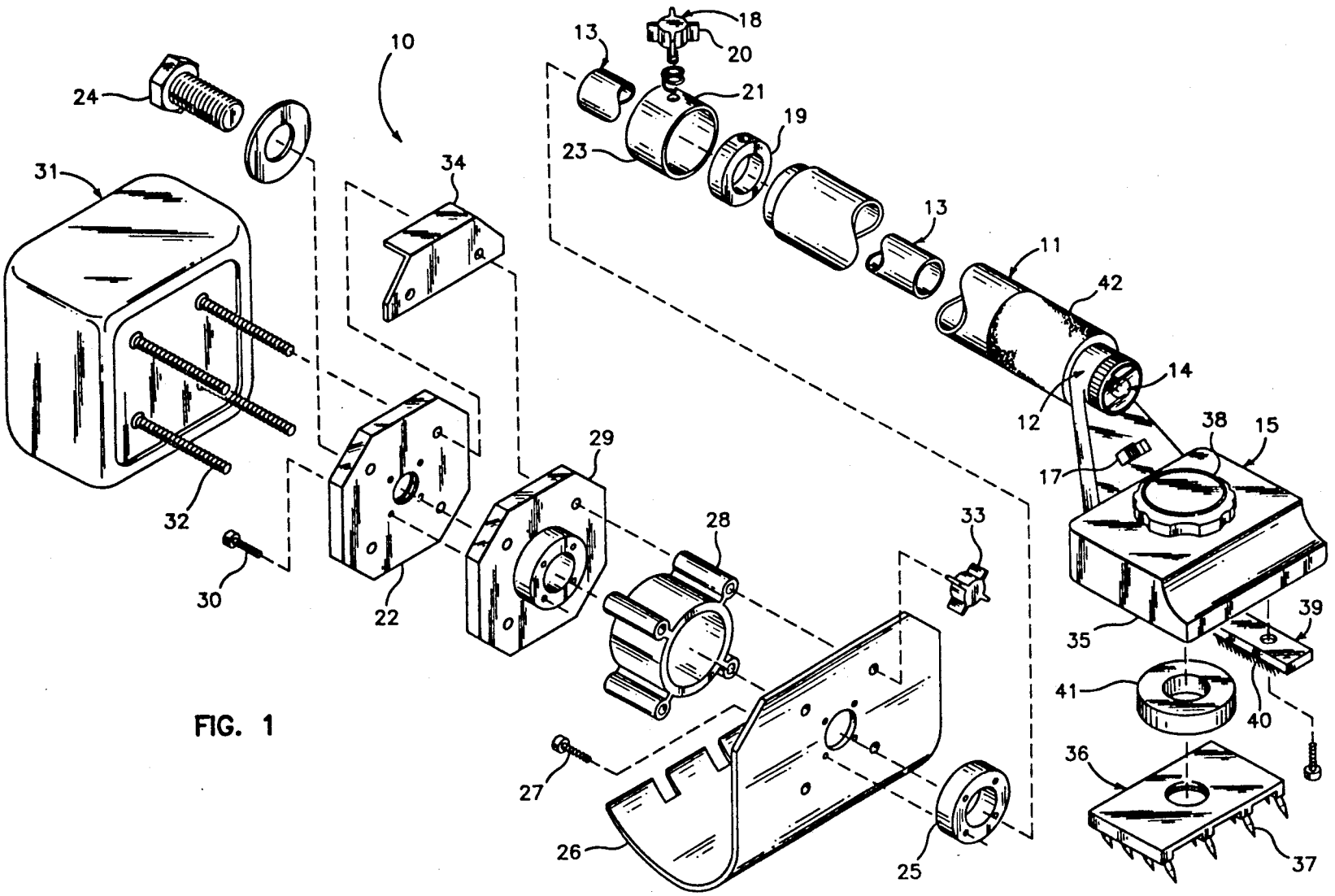
FIG. 1 is an exploded perspective view of the adjustable carpet stretcher.
Figures 2, 3:
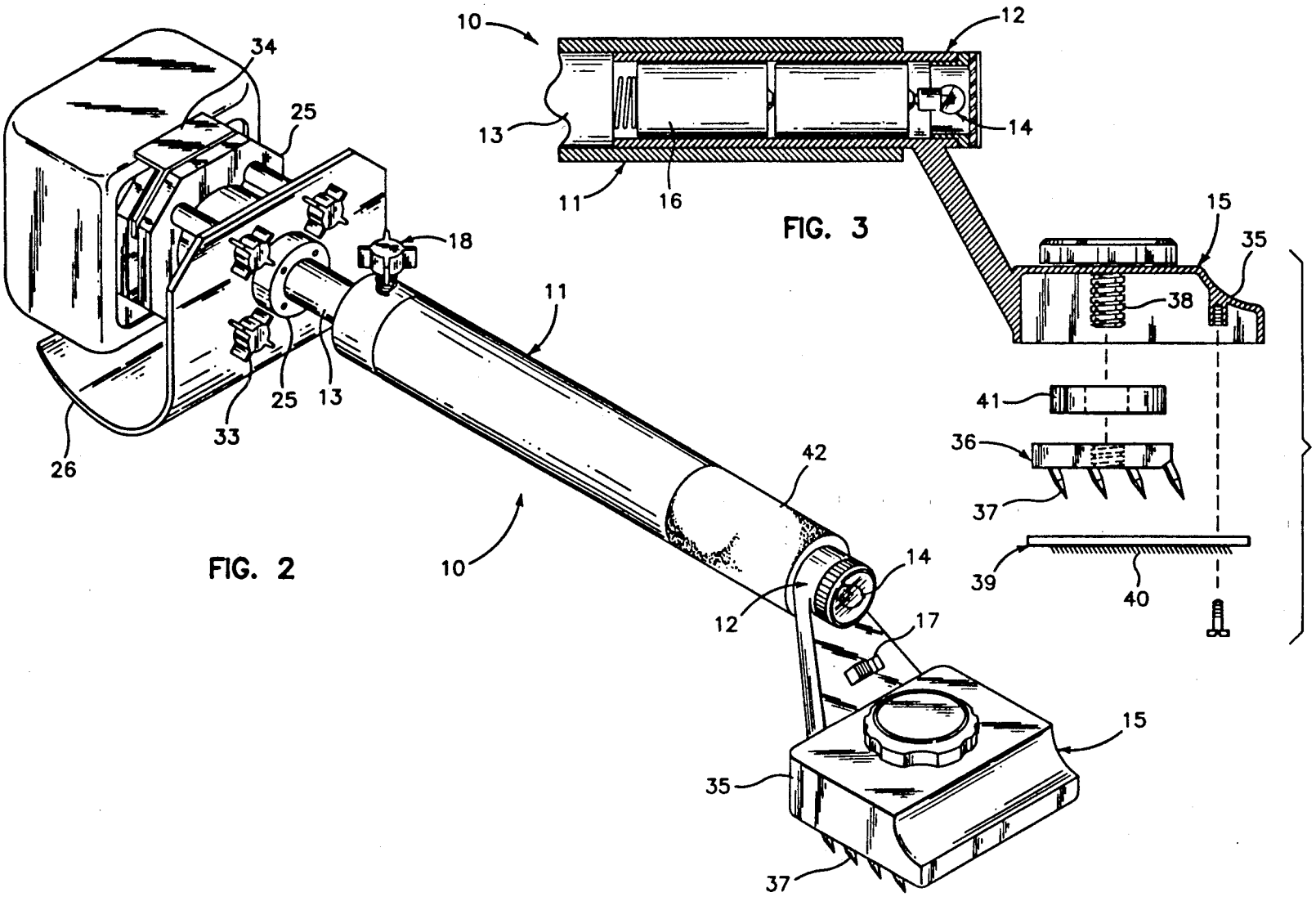
FIG. 2 is a perspective view of the adjustable carpet stretcher.
FIG. 3 is a partial, enlarged, cross-sectional view of the adjustable carpet stretcher showing an exploded view of the carpet gripping head.

An adjustable carpet stretcher 10 used in combination with a carpet (not shown) is shown in FIGS. 1 through 3.

The carpet stretcher 10 has an outer tubular member 11, a first inner tubular member 12 within the outer tubular member 11 and a telescoping second inner tubular member 13 within the outer tubular member 11. There is a light device 14, in the first inner tubular member 12 to illuminate an area near the gripping head 15 and a power source 16 for the light device 14. Part of the lighting device 14 is the switch 17 shown on gripping head 15.

There is a locking member 18, engageable with the second inner tubular member 13, to releasingly secure the outer tubular member 11 to the second inner tubular member 13. Part of the locking member is a lock bolt 20 and an outer lock bushing 21. There is an outer tubular member stabilizer bushing 19 on the second inner tubular member 13. The lock bolt also passes through stabilizer bushing 19 and contacts the second inner tubular member 13.

A securing bushing 22 is releasingly attached to the second inner tubular member 13 at end 23 by a second inner tubular member fastener 24 shown in FIG. 1 as a bolt 24. There is a mounting bushing 25 on the second inner tubular member 13. There is a carpet skid 26 releasingly attached (by a plurality of screws 27) to the mounting bushing 25. There is a spacer member 28 on the second inner tubular member 13. There is a mounting plate 29 releasingly secured to the securing bushing 22 by screws 30.

A knee pad 31 is releasingly connected by bolts 32 to the carpet skid 26. Bolts 31 pass through bushing 22, plate 29, spacer 28 and carpet skid 26 thereby assisting in the securing of those elements. The bolts 31 may have a easy-off type of nut 33, as is shown, to assist in disassembly of the stretcher 10. There is a knee pad retaining member 22, attached to the securing bushing 34 by bolts 32, to restrict the movement of the knee pad 31.

A carpet gripping head 15 is attached to the first inner tubular member 12. The carpet gripping head 15 has a base plate 35 and a primary tooth plate 36, adjustably and removably attached to the base plate 35, that has a plurality of primary teeth 37 thereon.

There is a primary tooth plate adjustment member 38, adjustably attached to the base plate 35 and to the primary tooth plate 36, to adjust a depth to which the primary teeth 37 of the primary tooth plate 36 may penetrate the carpet. There is at least one secondary tooth plate 39, removably attached to the base plate 35, having a plurality of secondary teeth 40. There is a tooth plate stabilizer bushing 41 to reduce movement of the primary tooth plate 36. The tooth plate stabilizer bushing 41 may be supplied in a kit (not shown) that provides a selection of bushings 41 of varying thicknesses. The outer tubular member 11 has a gripping surface 42 on a surface of an outer wall. The gripping surface 42 may be applied in any conventional manner.

The foregoing descriptions and drawings of the invention are explanatory and illustrative only, and various changes in shape, sizes and arrangements of parts as well certain details of the illustrated construction may be made within the scope of the appended claims without departing from the true spirit of the invention.

I claim:

1. An adjustable carpet stretcher used in combination with a carpet comprising:

a. an outer tubular member;

b. a first inner tubular member within the outer tubular member;

c. a telescoping second inner tubular member within the outer tubular member;

d. a locking member, engageable with the second inner tubular member to releasingly secure the outer tubular member to the second inner tubular member;

f. an outer tubular member stabilizer bushing on the second inner tubular member;

g. a securing bushing releasingly attached to the second inner tubular member by a second inner tubular member fastener;

h. a central mounting plate, on the second inner tubular member, releasingly attached to the securing bushing;

i. a spacer member on the second inner tubular member;

j. a mounting bushing on the second inner tubular member;

k. a carpet skid releasingly attached to the mounting bushing;

l. a knee pad releasingly connected to the carpet skid;

m. a knee pad retaining member, attached to the securing bushing, to restrict the movement of the knee pad; and n. a carpet gripping head attached to the first inner tubular member.

2. An adjustable carpet stretcher as described in claim 1 wherein the carpet griping head further comprises;

a. a base plate;

b. a primary tooth plate, adjustably and removably attached to the base plate, having a plurality of primary teeth;

c. A primary tooth plate adjustment member, adjustably attached to the base plate and to the primary tooth plate, to adjust a depth to which the primary teeth of the primary tooth plate may penetrate the carpet;

d. at least one secondary tooth plate, removably attached to the base plate, having a plurality of secondary teeth; and e. a tooth plate stabilizer bushing to reduce movement of the primary tooth plate.

3. An adjustable carpet stretcher used in combination with a carpet comprising:

a. an outer tubular member;

b. a first inner tubular member within the outer tubular member;

c. a telescoping second inner tubular member within the outer tubular member;

d. a locking member, engageable with the second inner tubular member, to releasingly secure the outer tubular member to the second inner tubular member;

f. an outer tubular member stabilizer bushing on the second inner tubular member;

g. a securing bushing releasingly attached to the second inner tubular member by a second inner tubular member fastener;

h. a mounting plate, on the second inner tubular member, releasingly attached to the securing bushing;

i. a spacer member on the second inner tubular member;

j. a mounting bushing on the second inner tubular member;

k. a carpet skid releasingly attached to the mounting bushing;

l. a knee pad releasingly connected to the carpet skid;

m. a knee pad retaining member, attached to the securing bushing, to restrict the movement of the knee pad; and n. a carpet gripping head attached to the first inner tubular member comprising:

a base plate;

a primary tooth plate, adjustably and removably attached to the base plate, having a plurality of primary teeth;

a primary tooth plate adjustment member, adjustably attached to the base plate ant to the primary tooth plate, to adjust a depth to which the primary teeth of the primary tooth plate may penetrate the carpet;

at least one secondary tooth plate, removably attached to the base plate, having a plurality of secondary teeth;

a tooth plate stabilizer bushing to reduce movement of the primary tooth plate; and o. the first inner tubular member comprising:

a light device to illuminate an area near the gripping head; and a power source for the light device.

4. An adjustable carpet stretcher as described in claim 1 wherein the outer tubular member comprises a gripping surface on a surface of an outer wall.

* * * * *